United States Patent [19]

Lincoln

[11] Patent Number: 4,943,245

[45] Date of Patent: Jul. 24, 1990

[54] COAXIAL ELECTRICAL CONNECTOR

[75] Inventor: Thomas C. Lincoln, South Pasadena, Calif.

[73] Assignee: Microdot Inc., Chicago, Ill.

[21] Appl. No.: 386,694

[22] Filed: Jul. 31, 1989

[51] Int. Cl.[5] ..... H01R 13/00
[52] U.S. Cl. ..... 439/578
[58] Field of Search ..... 439/579–585

[56] References Cited

U.S. PATENT DOCUMENTS

| | | | |
|---|---|---|---|
| 2,754,487 | 7/1956 | Carr et al. | 439/578 |
| 4,206,963 | 6/1980 | English et al. | 439/578 |
| 4,326,769 | 4/1982 | Dorsey et al. | 439/578 |
| 4,426,127 | 1/1984 | Kubota | 439/578 |

*Primary Examiner*—Joseph H. McGlynn
*Attorney, Agent, or Firm*—Lyon & Delevie

[57] ABSTRACT

A matched impedance coaxial connector for use in the transmission of high frequency signals utilizing a twist pin connector combined with a sliding interface which does not require full mating for successful performance.

2 Claims, 1 Drawing Sheet

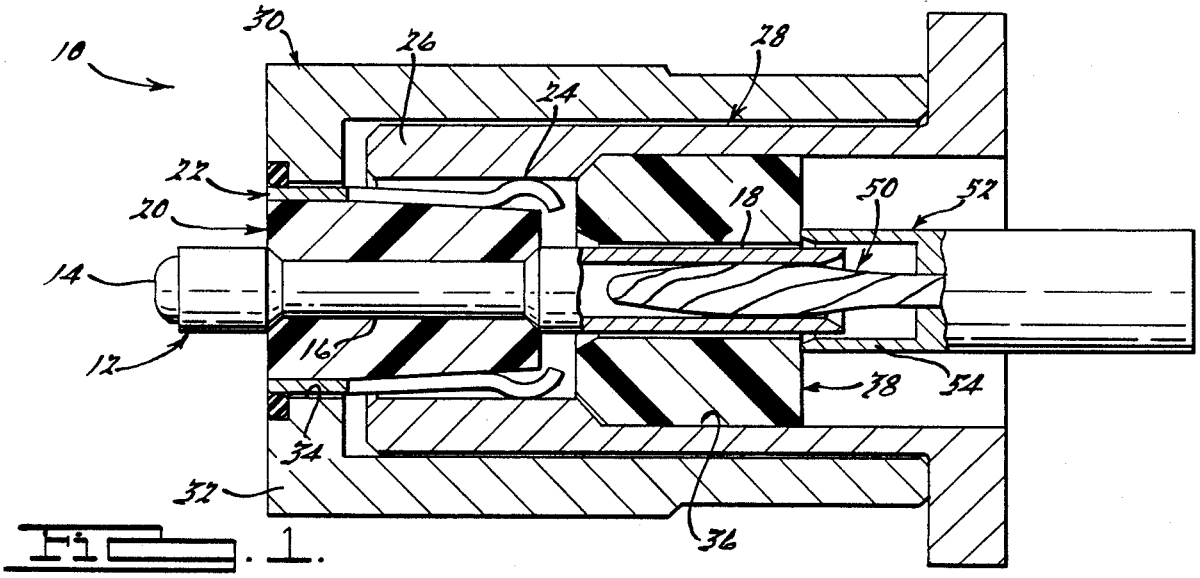
FIG. 1.
FIG. 2.
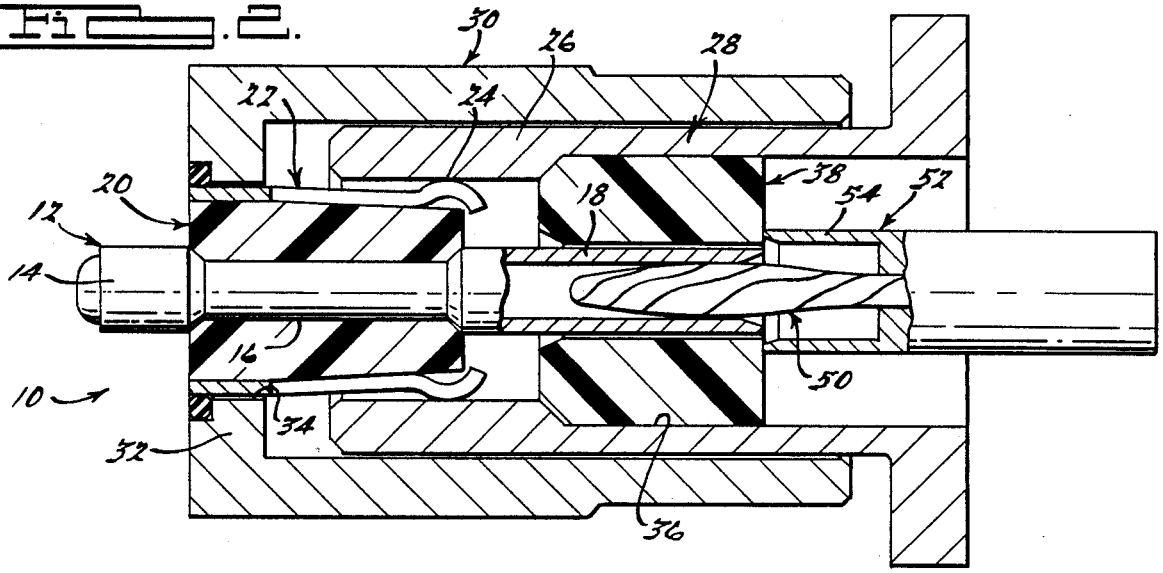
FIG. 3.
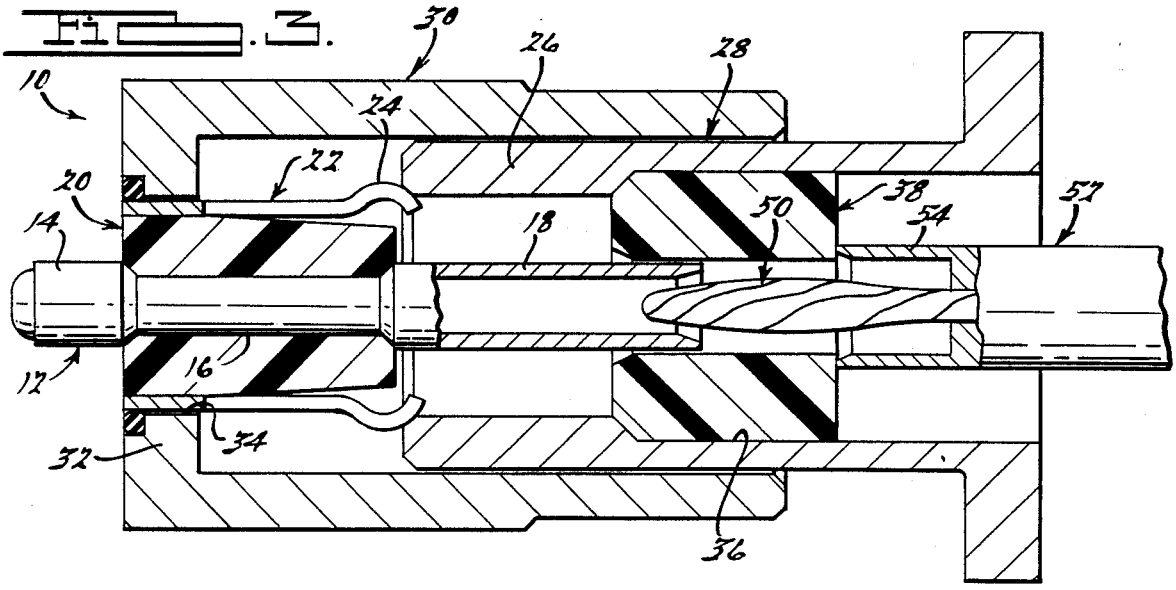

COAXIAL ELECTRICAL CONNECTOR

BACKGROUND OF THE INVENTION

This invention relates generally to coaxial electrical connectors and more particularly to a controlled impedance coaxial electrical connector having a twist pin contact.

It is desirable for a coaxial electrical connector to exhibit (a) electrical characteristics which are constant so that the connector introduces the least possible variation into the propagation of electrical signals therethrough, and (b) mechanical strength to insure said electrical characteristics. Deficiencies in connector performance are especially problematic when dealing with the transmission of high frequency signals (greater than 1.5 GHz for example) wherein slight variations in signal path impedance may dramatically impact transmission performance.

Coaxial electrical connectors heretofore used to interconnect the ends of high frequency transmission lines do not have a mechanical construction that fully stabilizes the electrical characteristics of the connector. Specifically, the V.S.W.R. (Voltage Standing Wave Ratio) through the connector has heretofore been subject to appreciable variation due to minor changes of position or "float" of the parts effected by manufacturing tolerances and stress experienced by the connector and cables connected thereby.

SUMMARY OF THE INVENTION

The present invention relates to an improved configuration and orientation of the components of a coaxial connector. The connector utilizes a shrouded twist pin contact that is accepted in a socket contact as the interfaced signal carrier. The socket contact is accepted in the shrouded portion of the twist pin bundle. A relatively constant impedance ratio is maintained by positively locating the signal carriers radially relative to an outer housing, and by accommodating axial movement of the mating components from full mate to near unmate without impedance variation.

BRIEF DESCRIPTION OF THE DRAWINGS

FIG. 1 is a cross-sectional view of a fully mated controlled impedance connector in accordance with the present invention;

FIG. 2 is a view similar to FIG. 1 with the socket contact partially withdrawn relative to the twist pin; and FIG. 3 is a view similar to FIG. 1 with the socket contact disconnected from the twist pin.

DETAILED DESCRIPTION OF THE PREFERRED EMBODIMENT OF THE INVENTION

A controlled impedance connector 10 of the instant invention is based on the equation $$Z = \frac{138}{2K} \log(10) \frac{D}{d}$$

where Z=desired impedance level, 50 ohms for example, K=dielectric constant of the insulation material, D=I.D. of the outer conductor, d=O.D. of the inside conductor.

As K is an inherently constant value it is readily apparent that control of the D/d ratio is essential to achieve stabilization of the impedance within the connector for satisfactory performance.

A connector 10, for a conventional high frequency transmission line (not shown) in accordance with a constructed embodiment of the instant invention, comprises a female contact 12 having a conventional terminal end portion 14, an intermediate cylindrical portion 16 and a tubular inner end portion 18. An insulating sleeve 20 surrounds the intermediate portion 16 of the female contact 12 to effect radial positioning and insulation thereof from a spring sleeve 22. The sleeve 22 has a plurality of axially extending spring fingers 24 that effect frictional engagement and electrical continuity with a complimentary outer end portion 26 of a tubular male contact housing 28.

The male housing 28 is telescopically accepted in a female contact housing 30. The female contact housing 30 has a radially extending end wall 32 with an aperture 34 therein for acceptance of the spring sleeve 22.

The male housing 28 is of tubular configuration having an increased inside diameter portion 36 for the acceptance of a tubular insulator 38.

The insulator 38 functions to radially stabilize the socket portion 18 of the female contact 12.

In accordance with one feature of the instant invention a twist pin male contact 50 is supported in a male contact sleeve 52 having a tubular portion 54 which telescopically accepts the tubular socket portion 18 of the female contact 12. In this manner, the male twist pin contact 50, socket portion 18 of the female contact 12, pin contact 52, insulator 38, male housing 28, and female housing 30 are radially stabilized relative to one another.

As best seen by comparing FIGS. 1, 2, and 3, the aforesaid radial relationship is maintained upon axial displacement of the female housing 30 relative to the male housing 28. As the terminal end portion 18 of the female contact 12 passes within the insulator region, as shown in FIG. 2, an impedance change does occur as a result of changed variable conditions in the aforementioned equation. As a result of the aforementioned control of radial position, however, transmission performance at the frequencies of interest, 1–10 GHz, for example, is substantially unaffected for the short distance of travel demonstrated by the change in position from FIG. 2 to FIG. 3. As a result, electrical continuity and signal transmission performance are maintained substantially constant until such time as the socket portion 18 of the female contact 12 disengages from the twist pin contact 50, as seen in FIG. 3.

From the foregoing it should be apparent that radial movement of the signal carriers 12 and 50 of the connector 10 relative to their electrical shielding housings 28 and 30, respectively, is precluded. However, axial movement of the signal carriers 12 and 50 is accommodated without affecting a detectable change in impedance of the connector 10.

In another embodiment of the instant invention (not shown), dimensional adjustments to the width of the insulator 38 may be made to decrease the distance of travel from the position of impedance change, similar to that in FIG. 2, to the position of discontinuity, similar to that in FIG. 3, for applications wherein even tighter control may be required.

While the preferred embodiment of the invention has been disclosed, it should be appreciated that the invention is susceptible of modification without departing from the spirit of the invention or the scope of the subjoined claims.

I claim:

1. A matched impedance pin connector comprising a tubular female contact having an open end, a male contact acceptable in the open end of said female contact, a male contact sleeve surrounding one end of said male contact in radially spaced relation to and electrically connected thereto, a male contact housing disposed about said male contact sleeve in radially spaced co-axial relation thereto, a first annular insulator disposed interiorly of said male contact housing in axially aligned relation to said male contact sleeve, said first annular insulator and male contact sleeve having substantially equal inside diameters for the telescopic acceptance of said female contact, a female contact housing disposed about said female contact in radially spaced coaxial relation thereto and having an inside diameter substantially equal to the outside diameter of said male contact sleeve for the acceptance thereof in telescopic relationship, and a second annular insulator interposed between said female contact and said female contact housing to maintain a constant radial spacing therebetween.

2. The connector of claim 1 further comprising a spring sleeve disposed about said second annular insulator and having a plurality of spring fingers extending axially therefrom, said fingers frictional engaging with said male contact housing.

* * * * *